United States Patent [19]

Moody et al.

[11] 4,421,182

[45] Dec. 20, 1983

[54] COMBINATION CLEAN-OUT AND DRILLING TOOL

[76] Inventors: Arlin R. Moody, Rte. 1, Anton, Tex. 79313; Bobby J. Moody, Hwy. 114 West, Levelland, Tex. 79336

[21] Appl. No.: 358,652

[22] Filed: Mar. 16, 1982

[51] Int. Cl.[3] ..... E21B 21/10

[52] U.S. Cl. ..... 175/65; 175/213; 175/308; 166/105.1; 166/321

[58] Field of Search ..... 175/65, 308, 234, 213; 166/105.1–105.4, 99, 107, 167, 311, 319, 321

[56] References Cited

U.S. PATENT DOCUMENTS

| | | | |
|---|---|---|---|
| 1,968,282 | 7/1934 | Cavins | 166/301 |
| 2,088,151 | 7/1937 | Cavins | 166/311 |
| 2,894,585 | 7/1959 | Erwin | 166/301 |
| 2,992,682 | 7/1961 | Yates | 166/107 |
| 3,255,820 | 6/1966 | Brandon | 166/249 |
| 3,406,757 | 10/1968 | Baumstimler | 166/99 |
| 3,446,283 | 5/1969 | Baumstimler | 166/311 |
| 3,651,867 | 3/1972 | Baumstimler | 166/99 |
| 4,043,150 | 8/1977 | Baumstimler | 166/311 X |
| 4,142,583 | 3/1979 | Brieger | 166/311 |
| 4,161,985 | 7/1979 | Fournier et al. | 166/321 |
| 4,190,113 | 2/1980 | Harrison | 166/311 |

*Primary Examiner*—Stephen J. Novosad

*Assistant Examiner*—Thuy M. Bui

*Attorney, Agent, or Firm*—Richards, Harris & Medlock

[57] ABSTRACT

A tool (10) is disclosed which permits clean-out of a bore hole in either a hydrostatic or hydraulic operation. In addition, the tool (10) may be used to drill a formation within the bore hole without the need for circulation of fluid to the surface to remove cuttings from the formation. The tool (10) includes an upper assembly (12) and a lower assembly (14). The lower assembly (14) includes a debris chamber (144) and a trap valve (148) for permitting one-way flow of debris and fluid therein. In hydrostatic operation, a lower valve assembly, (126) is provided to prevent fluid entry into the spaces above the assembly in the tool and drill or tubing string assembly until the tool reaches the debris in the bore hole. Downward motion of a seal, guide and swab piston assembly (102) opens the valve assembly to drive the debris and fluid into the debris chamber. In hydraulic operation, the lower valve assembly (126) is removed and an upper valve assembly (40) is positioned within the upper assembly. Reciprocation of the seal, guide and swab piston assembly (102) drives debris and fluid into the debris chamber on the upstroke. On the downward stroke of the piston assembly, pressure is relieved through the upper valve assembly and discharged to the bore hole through discharge and relief valves (132, 134).

21 Claims, 3 Drawing Figures

COMBINATION CLEAN-OUT AND DRILLING TOOL

TECHNICAL FIELD

This invention relates to oil field production, and in particular to down hole operating devices.

BACKGROUND ART

An oil well is a hole bored through layers of rock formations to reach a level or bed of petroleum or gas. The desired petroleum or gas is often found at a depth as deep as 25,000 feet to 30,000 feet. After the initial bore hole is drilled with a drilling rig, a casing is run into the bore hole and cemented to the sides of the bore hole to keep the bore hole from collapsing.

If a casing is provided along the entire length of the borehole, the casing is perforated at the proper level to permit the top of the petroleum or gas to enter the casing for recovery. The casing may be run into the bore hole down to the hydrocarbon producing formation. This technique is referred to as open hole completion. The portion of the bore hole below the deposit is then unprotected from collapsing.

Almost all of the gas or oil wells drilled require some type of treatment to render the well productive. This often includes the pumping of acid; or acid and different sizes and grades of salt; or sand pumped under high pressure to fracture the formation in the oil or gas bearing layer. When the treatment is completed, some debris, formed by the acid, sand, salt or other material, is left in the bore hole. This commonly leads to closing the hydrocarbon or gas producing formations to stop recovery.

Several techniques have been developed to remove debris from within a bore hole. A reverse unit may be employed which includes a rotary device above the oil or gas bore hole to turn a drill pipe or tubing. The drill pipe or tubing has a drill bit on the bottom end thereof and is run down into the bore hole to drill through the debris for cleaning or cleaning by drilling the well deeper. The reverse unit includes a pump on the surface at the bore hole for pumping fluid down hole to recover the debris and pump it to the surface. However, this technique is not always possible. Sometimes, cleaning or drilling circulation is impossible. In other instances, fluid may not be placed in gas wells as it will push the gas back into the formation and prevent little, if any, recovery of the gas.

To overcome this problem, several wire line clean-out tools have been developed. The tools are placed down hole on a wire line or cable suspended from the surface. The wire line tools basically operate on two principals, either hydraulic or hydrostatic. A hydraulic device is disclosed in U.S. Pat. No. 4,190,113 to Harrison issued Feb. 26, 1980. This type of device operates by alternately evacuating and pressurizing a debris chamber with a pumping unit activated by the wire line. A one-way valve entering the debris chamber from the bore hole permits debris to flow into the debris container when the container chamber is evacuated. The debris is blocked from flowing out of the borehole by the valve when the chamber is pressurized. The pumping assembly is operated until the debris container chamber is full of debris. The tool is then removed and cleaned for reuse.

Fluid pumped by the pumping assembly is discharged horizontally from ports in the device into the narrow annular space between the device and borehole. This inhibits fluid motion downward in this annular space past these ports. In another device disclosed in this patent, a tubing string extends to the surface above the debris chamber. A kelly permits rotation of a notched collar below the chamber through the tubing string to break debris crust in the well bore. The presence of an empty tubing string in the well bore raises the potential for tubing collapse if the hydrostatic pressure in the well bore acting on the walls of the tubing string becomes to large.

The previously known hydraulic types of tools have several shortcomings. The vacuum within the chamber is limited and heavy or large debris will not be recovered. The pumping action also permits the tool to become submerged within the debris and possibly be incapable of recovery by the wire line. An extremely costly and time consuming fishing job is then required to get the tool from the well.

U.S. Pat. Nos. 3,406,757, 3,446,283 and 3,651,867, issued on Oct. 11, 1968, May 27, 1969 and Mar. 28, 1972, respectively describe hydrostatic tools. Each of these patents is issued to Baumstimler. In a hydrostatic tool, the tool is run down the bore hole with a sealed debris chamber at atmospheric pressure. The tool is set down on top of the debris in the well. A valve is then opened permitting the fluid in the bore hole to enter the debris chamber. With sufficient fluid in the bore hole, the hydrostatic head is much greater than the atmospheric pressure within the debris chamber and the inrush of fluid entrains debris into the debris chamber. The tool must then be lifted from the bore hole to remove the debris in the debris chamber.

The hydrostatic tool also suffers shortcomings. The hydrostatic head in the bore hole where the debris is located must be relatively high to permit satisfactory operation of the hydrostatic tool. It is quite expensive to add sufficient fluid to the bore hole to achieve this hydrostatic head if it is not provided naturally. When the well is returned to production, the fluid has to be recovered and disposed of at additional cost. While the hydrostatic tool is effective on large and heavy debris, there is little control of how much the debris containing chamber will contain. Prior known tools provide little control of fluid motion once the debris chamber is exposed to the bore hole pressures and the hydrostatic tool can easily become submerged within the debris and require a fishing operation for removal.

A need exists for a tool which may be employed as either a hydraulic or hydrostatic tool without major modifications to achieve the advantages of either tool operation in a particular application. A need also exists to develop a tool with a capacity to provide sufficient forces to lift the tool in either mode of operation from within the debris in the bore hole. U.S. Pat. No. 2,992,682 issued July 18, 1961 to Yates discloses a combination tool operable in both the hydrostatic and hydraulic mode. However, this tool is not readily transferrable from one mode of operation to the other and still retains the shortcoming of other known tools in failing to provide an effective technique for removing the tool from the bore hole when buried in debris.

SUMMARY OF THE INVENTION

A tool for use in a bore hole for debris collection is provided. The tool includes a lower assembly having structure for mounting an accessory at the lower end thereof in the bore hole. A debris chamber is provided in the lower assembly for holding debris. A one-way valve positioned in communication with the bore hole and debris chamber permits fluid to flow only from the bore hole into the debris chamber. A barrel section in the lower assembly has a smooth cylindrical inner wall and is also in fluid communication with the debris chamber through a lower valve assembly. Closure structure encloses the upper end of the barrel section in the lower assembly which includes a noncircular aperture therethrough. An upper assembly is provided which has a hollow kelly with a noncircular cross section for sliding motion through the aperture in the closure structure for joint rotation of the upper and lower assemblies. A piston assembly is mounted on the kelley in sliding sealed contact with the inner wall of the barrel section and has at least one port for fluid communication between the debris chamber and hollow kelley, the closure structure and piston assembly being engageable to jerk the lower assembly free from debris. The lower part of the piston assembly further acts to open the lower valve assembly to permit flow between the debris chamber and hollow kelly. A fluid container in the upper assembly is provided in fluid communication with the hollow portion of the kelley. A drain valve is in fluid communication with the fluid container and the bore hole to relieve fluid pressure from the fluid container. An upper valve assembly permits flow only from the hollow kelley into the fluid container.

The tool is operable as a hydraulic tool by removing the lower valve assembly and oscillating the upper assembly to reciprocate the piston assembly and drive fluid and debris into the debris chamber during the upstroke. At least one discharge valve is provided in fluid communication with the debris chamber. The upper valve assembly and discharge valve open on the downstroke to release the pressure in the debris chamber. The tool is operable as a hydrostatic tool by removing the upper valve assembly with the lower valve assembly in place and moving the kelley downward to open the lower valve assembly, driving fluid and debris into the fluid chamber.

In accordance with another aspect of the present invention, the lower assembly secures a drill bit at its bottom end in the bore hole. Rotation of the upper and lower assemblies rotates the drill bit and permits drilling operation within the bore hole.

In accordance with yet another aspect of the present invention, jet ports are provided proximate the one-way valve between the bore hole and the debris chamber. The jet ports act to agitate and moisturize the debris within the tool for improved debris collection. Jet ports are also provided in the closure structure in communication with the interior of the barrel section for agitating debris upon upstroke of the piston assembly.

In accordance with another aspect of the present invention, a method for drilling a bore hole is provided. The method includes the step of rotating a tool with a drill string or tubing assembly. The tool has upper and lower assemblies with a drill bit being mounted on the lower assembly for contact with the formation to be drilled. The method further includes the step of reciprocating the upper assembly relative to the lower assembly. The upper assembly includes a piston assembly in slideable sealed contact with an inner sealing surface in a section of the lower assembly. The motion of the piston assembly drives fluid and debris from the bore hole into a debris container in the lower assembly to collect the cuttings formed during the drilling.

BRIEF DESCRIPTION OF THE DRAWINGS

A more complete understanding of the invention may be had by reference to the following Detailed Description when taken in conjunction with the accompanying drawings, wherein.

DETAILED DESCRIPTION

Figure 1:
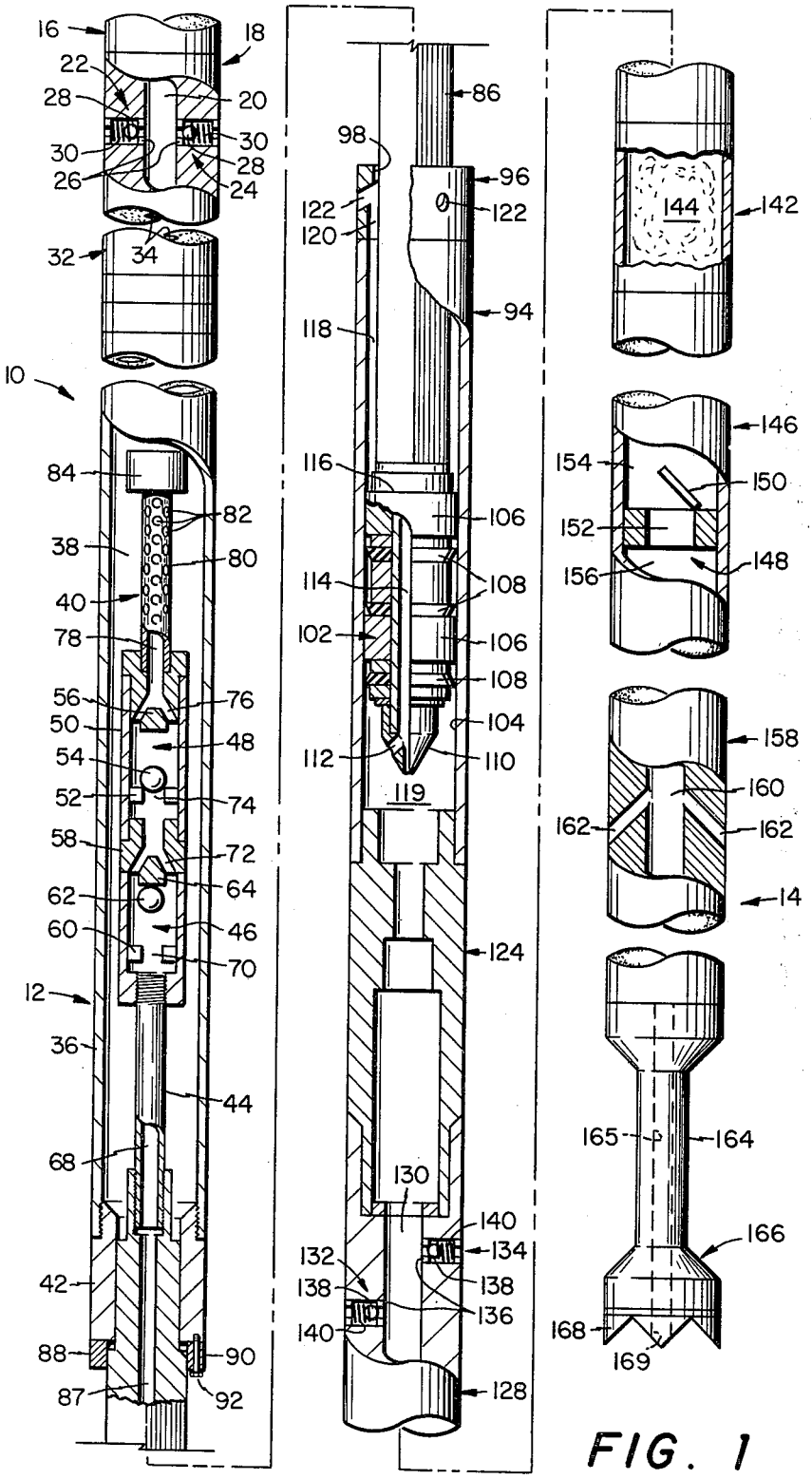
FIG. 1 is a vertical cross sectional view of a tool forming one embodiment of the present invention adapted for use as a hydraulic clean-out or drilling tool.
Figure 2:
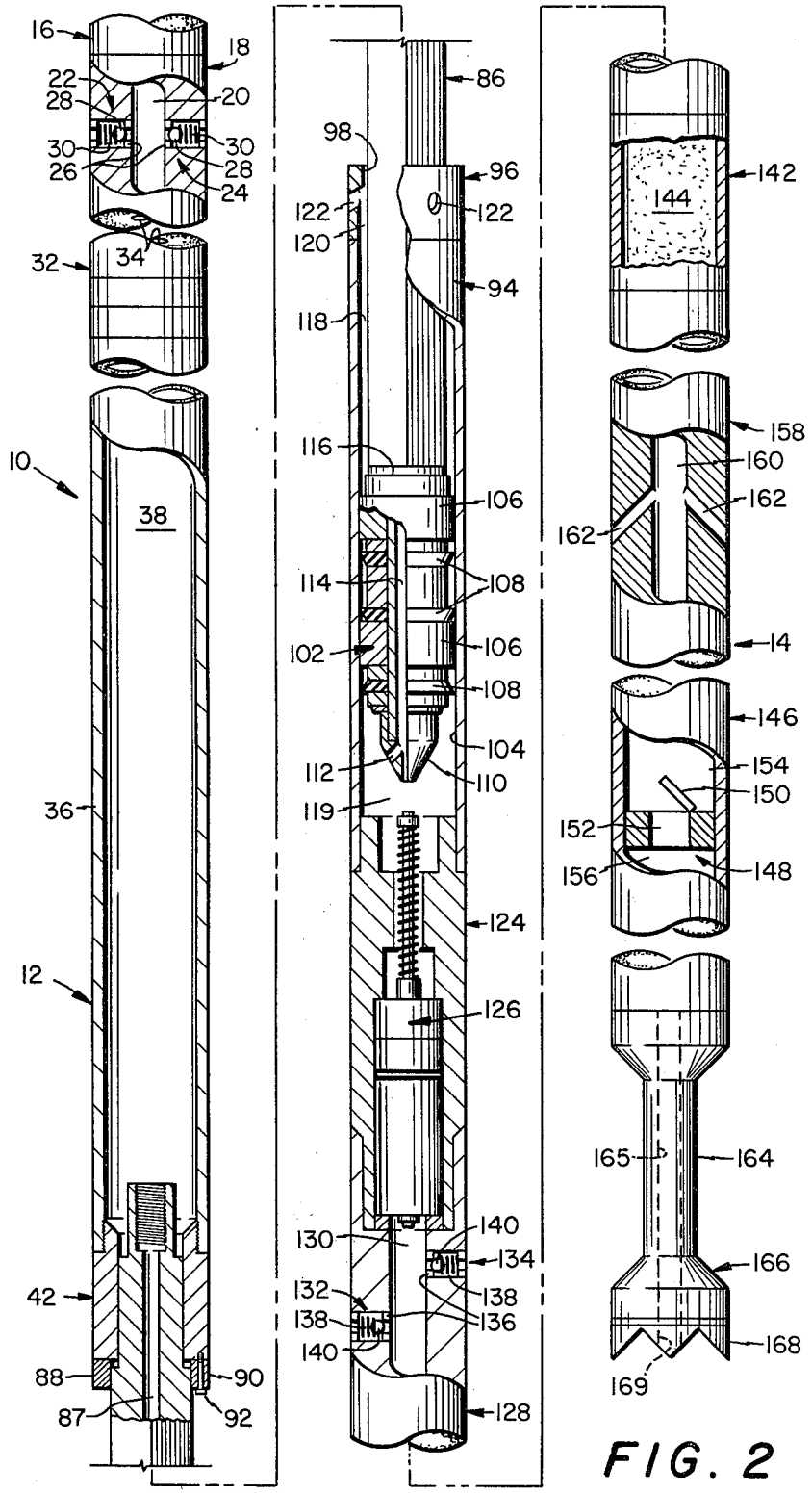
FIG. 2 is a vertical cross sectional view of the tool adapted for use as a hydrostatic clean-out or drilling tool.

Referring now to the drawings, wherein like reference characters designate like or corresponding parts throughout several views, FIGS. 1 and 2 illustrate a tool 10 forming one embodiment of the present invention. The tool 10 functions as an improved clean-out tool and is operable in either a hydrostatic or hydraulic mode. In addition, the tool 10 may be operated as a drilling tool to drill a bore hole without need for circulation of drilling fluid from the surface to remove cuttings from the drill face as required in present drilling apparatus.

FIG. 1 illustrates the tool 10 employed as a hydraulic clean-out tool. Generally, the tool 10 comprises two major sections, an upper assembly 12 and a lower assembly 14. The upper assembly 12 is secured to the last section of a hollow core drill or tubing string assembly 16 which extends to the surface of the bore hole in which the tool is operated. The drill or tubing string assembly preferably comprises hollow tubing of the type employed in drilling operations.

The upper and lower assemblies are vertically aligned in the bore hole and reciprocal relative to each other as will be described in greater detail hereinafter. The upper assembly includes a drain valve subassembly 18 which is secured to the lower section of an assembly 16. The subassembly 18 includes a passageway 20 in fluid communication with the hollow core of the assembly. Drain valves 22 and 24 are provided which act to relieve fluid pressure from within passageway 20 to the bore hole. Each drain valve includes a valve seat 26, a valve ball 28 and a spring 30 to urge the ball into engagement with the valve seat with a predetermined force.

When the tool 10 is lowered into fluid within the bore hole, the tool admits fluid from the bore hole through the passageway 20 and into the hollow tubing forming the assembly 16. This reduces the buoyancy of the tool and assembly 16 to ensure proper operation. When removing the tool and assembly 16, it is necessary to permit the fluid to drain from the assembly 16 to lighten the total weight of the tool and assembly 16 and to prevent possibly explosive fluids from being dumped on the floor of the drilling or workover rig. The drain valves 22 and 24 perform this function. Dual drain valves are employed for safety if one malfunctions. The drain valves also vent excess gas pressure or fluid pressure from the lower sections of the tool 10. In one tool constructed in accordance with the teachings of the present invention, the springs 30 were designed to permit the drain valves 22 and 24 to open at a pressure differential between the passageway and bore hole of greater than 30 psi.

A fluid container subassembly 32 is threaded to the lower end of the drain valve subassembly 18. The fluid container assembly includes a fluid container 34 therein in fluid communication with passageway 20. The fluid container can comprise any length desired. Typical values of length for the fluid container are 4 feet, 60 feet and 120 feet.

An upper valve subassembly 36 is secured to the lower end of the fluid container subassembly 32. Upper valve subassembly 36 has a central passage 38 in fluid communication with the fluid container 34. The upper valve subassembly 36 encloses an upper valve assembly 40 secured to a kelly 86. At the lower end of the upper valve subassembly 36 is threaded a changeover 42. The changeover permits a section having tubing threads or tool joint threads such as subassembly 36 to be secured to a section having a spline drive such as kelly 86. The changeover 42 also mounts a nipple 44 which extends upwardly into the passage 38 and threadably mounts the upper valve assembly 40.

The upper valve assembly 40 includes two separate one-way valves 46 and 48. One-way valve 48 includes a housing 50 having a ball seat 52 and ball 54. A ball stop 56 is provided to limit the motion of ball 54. One-way valve 46 includes a housing 58 defining a ball seat 60. A ball 62 is moveable into sealing contact with the ball seat 60, limited in its motion by ball stop 64.

Nipple 44 includes a passage 68. The passage 68 communicates with the port 70 through valve ball seat 60. A passage 72 interconnects the port 70 with port 74 in ball seat 52. A passage 76 extends from the one-way valve 48 into a passage 78 in a perforated nipple 80. It is clear that fluid may pass from passage 68 through the one-way valves 46 and 48 through the ports 82 in nipple 80 into the passage 38. However, fluid may not pass from the passage 38 in reverse flow into passage 68.

The nipple 80 prevents debris in the assembly 16 and tool 10 above the upper valve assembly 40 from clogging or plugging the passages through valve assembly 40. With valve assembly 40 installed, reverse circulation of fluid from the surface can be performed to loosen tool 10 from debris if necessary. The reverse circulation would drive fluid down the bore hole from the surface, about the lower portions of tool 10 described hereafter, through valve assembly 40 and returning the fluid to the surface within assembly 16.

A fishing neck 84 is secured at the top of a perforated nipple 80. The neck 84 is adapted for attachment to a changeover tool inserted within tool 10 to unthread the entire upper valve assembly 40 from nipple 44 and remove assembly 40 while the tool is down hole. This permits conventional circulation downward within assembly 16 to be run within the tool to loosen the tool from debris if desired.

The kelley 86 having a square outer cross section, a hollow center 87 and threaded splines at each end is threaded at its upper end to the changeover 42. A changeover safety lock 88 is provided to prevent loosening of the spline threads between the kelley and changeover. The changeover safety lock includes a lock flange 90 and two socket head bolts 92 to secure the lock flange to the changeover.

The lower assembly 14 includes a barrel 94 having internal threads at each end. An upper barrel nut 96 is threaded into the upper threads on barrel 94. The upper barrel nut 96 has a square aperture 98 for passage of the kelley 86. The kelley extends into the interior of barrel 94 and threadedly receives a seal, guide and swab piston assembly 102 on its lower splines. The barrel 94 defines a smooth cylindrical honed inner surface 104 along a substantial portion of its interior length.

The seal guide and swab piston assembly is designed for sliding sealed contact with the inner surface 104. The piston assembly includes brass guides 106 for guiding the assembly in its motion. Lip seals 108 are provided to perform the sealing function. The lip seals are poly-packed. In an alternative, the seals may be formed of Chevron Uni-pack seals.

A conical valve opener 110 is provided at the lower end of the piston assembly 102. The valve opener includes ports 112 extending both vertically and obliquely to a passage 114 through the interior of the assembly 102. The passage 114 is in fluid communication with the hollow interior 87 of kelley 86.

The upper annular surface of assembly 102 defines an upper stop 116. The upper stop is adapted for engagement with the upper barrel nut 96. Should the lower assembly 14 become buried within debris in the bore hole, the drill string assembly 16 and upper assembly 12 may be jerked upwardly, bringing upper stop 116 into engagement with the nut 96 to jerk the lower assembly 14 free. This feature forms a significant improvement over clean-out tools currently used. The large tensile strength available in the drill or tubing string assembly 16 and tool 10 permits this jerking action to be very effective.

The piston assembly 102 and barrel 94 define an annular chamber 118 and chamber 119 within the interior of the barrel. Passageways 120 are formed within the upper barrel nut 96 which open at one end into the chamber 118. The passages extend to downwardly directed ports 122 opening into the bore hole. Rapid motion of the piston assembly 102 upwardly drives whatever fluid is in the chamber 118 through the passages 120 and ports 122 at a greatly increased velocity. The fluid emanating from the ports 122 agitates the debris and other material in the bore hole to render the clean-out operations more effective. In contrast to the Harrison devide disclosed in U.S. Pat. No. 4,190,113; fluid discharged from ports 122 provides down thrust to pull fluid in the bore hole downward past the ports to assist in agitation. In one embodiment constructed in accordance with the teachings of the present invention, four jet ports 122 are provided.

A lower valve subassembly 124 is threaded to the lower internal threads of barrel 94. The interior of lower valve subassembly 124 is designed to accept a lower valve assembly 126. However, the lower valve assembly 126 is not employed when tool 10 is used in a hydraulic clean-out tool mode. Therefore, the assembly 126 will be discussed in greater detail hereinafter in describing hydrostatic operation.

A discharge and relief valve subassembly 128 is secured to the lower end of the subassembly 124. A passage 130 is formed through the subassembly 124 which communicates within the lower valve subassembly and chamber 119 in the interior of barrel 94 below the piston assembly 102. The subassembly 128 mounts discharge and relief valves 132 and 134. Each discharge and relief valve includes a ball seat 136, a ball 138 and a spring 140 to urge the ball into engagement with the seat.

The valves 132 and 134 relieve pressure within the passage 130 to the bore hole. When the piston assembly 102 is moved downwardly, the discharge and relief valves will limit the pressure in the fluid in the passage 130. This also relieves the stress on the lip seals on the piston assembly 102 during the downstroke. The orifice sizes of the assembly 16 and tool 10 above valves 132 and 134 are preferably sized to permit sets of sealer balls to be dropped from the surface, through assembly 16 and tool 10 to block valves 22 and 24 and/or the valves 132 and 134 during circulation through the tool. In particular, the vertical port 112 is sized to permit passage of such sealer balls.

A debris chamber subassembly 142 is secured at the bottom of the discharge valve subassembly. The hollow interior of the subassembly 142 forms a debris chamber 144. In operation, the tool will drive fluid and debris from within the bore hole into the debris chamber where the debris will settle. When the debris chamber has been filled, the tool is removed from the bore hole and the chamber is cleaned for reuse. The standard length of debris chamber is 50 feet. However, any suitable length may be employed for a particular situation.

A trap valve subassembly 146 is secured at the bottom of the debris chamber subassembly 142. The assembly 146 mounts a trap valve 148 formed by flapper 150 pivotally secured at one edge to open and close a port 152. The port communicates between chambers 154 and 156 in the subassembly 146. Chamber 154 opens into the debris chamber 144 of the debris chamber subassembly 142. Upward motion of the piston assembly 102 creates a vacuum within the lower assembly sufficient to open the flapper valve 150 to drive debris and fluid therethrough from the bore hole.

A jet port subassembly 158 is secured at the bottom of the trap valve subassembly 146 which forms a passage 160 in communication with chamber 156. Changeable angled jet ports 162 extend upwardly and inwardly from the bore hole into the passage 160. On the upstroke of the piston assembly 102, fluid from the bore hole is driven through the jet ports 162 to agitate moisture and lift the debris in the passage 160 for more effective debris collection. In prior hydraulic devices, clogging of the tool was common as a result of dehydration of debris from a slurry, forming hard deposits within the tool, particularly when the debris is sandy.

A changeover tool 164 is secured at the bottom of the jet port subassembly. The changeover 164 has a hollow center 165 and supports an accessory 166 at its bottom end. In the device illustrated in FIG. 1, the accessory is a drill bit 168. The accessory includes a hollow core 169 cooperating with the hollow core in changover 164 to drive debris and fluid from the bore hole into passage 160 and eventually into debris chamber 144. Other accessories may be provided, such as a wash pipe, junk basket or other device adapted for a particular desired purpose. These accessories can be either devices which previously required circulation within the bore hole or not. As will be described hereafter, tool 10 will provide fluid circulation as necessary through its operation to render the accessories operative.

In operation, the tool 10 is run down the bore hole on the drill string assembly 16. As noted previously, for hydraulic operation, the upper valve assembly 40 is mounted within the upper valve subassembly 36. The lower valve assembly 126 is removed from the subassembly 124.

When the tool 10 has contacted the debris pile within the bore hole at drill bit 168, the drill string assembly 16 is reciprocated by a suitable mechanism at the surface. When the drill string assembly reciprocates, the upper assembly 12 duplicates the motion. The kelley and seal, guide and swab piston assembly 102 then reciprocates through aperture 98 and within the interior of barrel 94. On the downstroke of the seal, guide and swab piston assembly 102, substantially no resistance to the motion is provided by the fluid in the lower assembly. During this portion of motion, the discharge and relief valves 132 and 134 are employed to relieve pressure below the piston assembly 102. In addition, fluid may pass through the ports 112 in passage 114 in the seal, guide and swab piston assembly and through the one-way valves 46 and 48 in the upper valve assembly 40 for discharge through the drain valves 22 and 24.

On the upstroke, the one-way valves 46 and 48 close, evacuating the chamber in the interior of the lower assembly below the seal, guide and swab piston assembly 102. The vacuum drives debris and fluid from the bore hole through the internal passage 169 in the drill bit 168, through the flapper valve 150 and into the debris chamber 144 where the debris is deposited. As noted previously, the fluid within chamber 118 is driven through ports 122 to agitate the debris. The fluid passing through jet ports 162 further acts to agitate, moisturize and lift the debris in passage 160 to ensure effective collection.

If the tool 10 becomes stuck in the bore hole, the drill or tubing string assembly 16 may be jerked upwardly. This impacts the upper stop 116 against the upper barrel nut 96 to jerk the tool free. Reverse circulation can also be attempted. If this action is insufficient, a tool may remove the upper valve assembly 40 within the bore hole through attachment at the fishing neck 84. The changeover safety lock 88 is to prevent loosening of the kelly 86 from changeover 42. Conventional circulation can then be provided from the surface moving down the drill or tubing string assembly 16 and through the tool 10 to free the tool.

Figure 3:
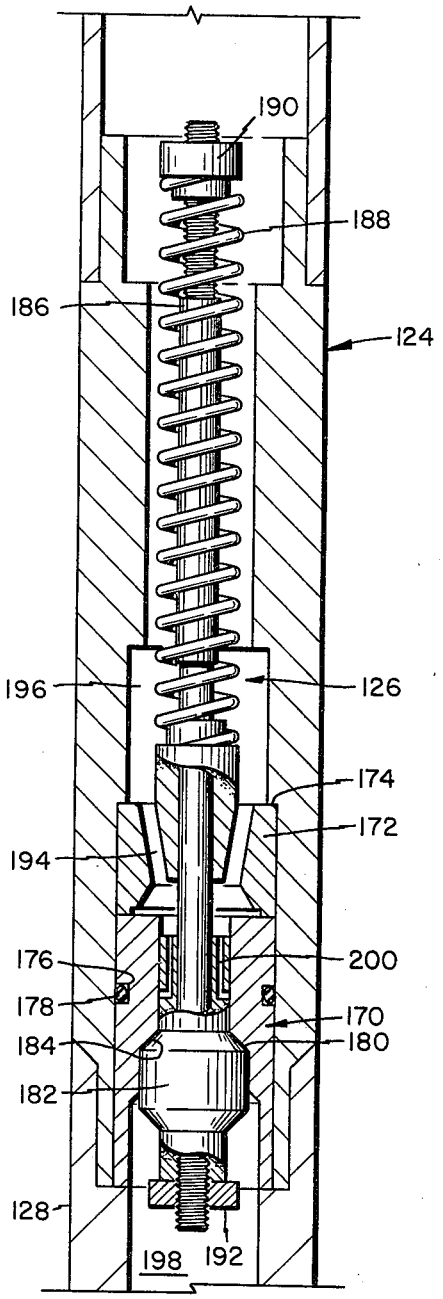
FIG. 3 is a vertical cross sectional view of the lower valve assembly used in the tool in hydrostatic operation.

When operation as a hydrostatic tool is desired, the tool 10 is configured as illustrated in FIGS. 2 and 3. Many components of tool 10 are used in both hydraulic and hydrostatic operation. One difference in operation as a hydrostatic tool is the removal of the upper valve assembly 40 and the placement of the lower valve assembly 126 within the subassembly 124. The details of the lower valve assembly 126 are best illustrated in FIG. 3.

The lower valve assembly 126 includes a valve body 170 and a valve guide 172 which are confined between the annular surface 174 of the subassembly 124 and the discharge and relief valve subassembly 128. A groove 176 is provided in the outer wall of the valve body to accept an O-ring 178. The O-ring 178 prevents flow of fluid and debris about the outside of the lower valve assembly.

The valve body 170 includes a seal surface 180 which cooperates with a valve 182 through a seal surface 184 thereon. A valve release rod 186 extends upwardly from the valve 182 through the center of the valve guide. A spring 188 acts between a spring retainer nut 190, threaded on an upper threaded portion of the valve release rod and valve guide to urge the sealing surfaces 180 and 184 into sealing engagement in the absence of external influence. A retainer nut 192 threaded on a lower threaded portion of rod 186 secures the rod 186 to the valve 182. Either or both nuts 190 and 192 are adjusted to vary the compression of spring 188 and preload of surface 184 against surface 180.

When the valve is positioned as shown in FIG. 3, no fluid may travel through the passageways 194 between chambers 196 and 198 in the subassembly 124. However, if the rod 186 is moved downwardly through contact with valve opener 110, the sealing surface 184 is disengaged from surface 180 to permit fluid flow between the chambers through the passages 194. The passages 200 ensure a safe closing of the valve when the valve release rod is permitted to move upwardly by slowing the closing of the valve under the tremendous head pressures often encountered down hole.

In adapting the tool 10 for hydrostatic operation, the jet port subassembly 158 is positioned between the trap valve subassembly 146 and debris chamber subassembly 142 as illustrated in FIG. 2. In operation, the tool 10 is lowered down hole and suspended from the drill or tubing string assembly 16. Air at atmospheric pressure is confned within the interior of the string assembly 16, upper valve subassembly 36, chamber 119 and chamber 196. As the tool descends within the bore hole, the jet ports 162 admit fluid and valves 132 and 134 discharge air from within the lower assembly to reduce bouyancy to prevent the valve opener 110 from coming into contact with the valve release rod 186 until the lower assembly 14 comes to rest on the debris within the bore hole with the upper assembly 12 movable downward to open the lower valve assembly 126. The assembly 16 is then moved downwardly to drive the valve opener 110 into the rod 186. This opens the lower valve assembly, permitting fluid and debris to rush into the debris chamber under the tremendous hydrostatic pressures typically found in bore holes where hydrostatic tool clean-out is most beneficial. When the pressures within the tool and drill string assembly have equalized, a large quantity of debris has been entered within the debris chamber and is maintained there by the trap valve 148. The tool may then be lifted to the surface for cleaning. Excess fluid in the assembly 16 and gas pressure is relieved by the drain valves 22 and 24 as the tool 10 moves to the surface. Discharge and relief valves 132 and 134 relieve pressure in the debris chamber 144 and lower assembly. Residual gas and pressure in down hole tools brought to the surface can be very hazardous to both equipment and personnel. Conventional and/or reverse circulation through the tool 10 is possible in the hydrostatic mode by holding lower valve assembly 126 open.

One significant advantage of tool 10 used in either hydrostatic or hydraulic operation is the ability to mount accessory 166 at the lower end of the lower assembly 14. When drill bit 168 is provided, the drill string assembly 16 may be rotated from the surface to rotate the drill bit against the debris. The square cross section of the kelley 86 and aperture 98 ensures that both lower and upper assemblies 12 and 14 rotate as a unit. The tool 10 may therefore be used to drill cement retainers or any type of plug or packer.

In addition, the tool 10 may be used with accessories using circulation since tool 10 provides fluid circulation in either the hydraulic or hydrostatic modes. If the accessory is a drill bit, tool 10 is capable of drilling a new hole or formation without the need for conventional or reverse fluid circulation to remove cuttings as presently used in drilling operations. For example, if sufficient fluid is provided in the bore hole to permit hydraulic operation of the tool 10, the drilling can be done by simultaneously reciprocating and rotating the drill string assembly, tool and drill bit. The cuttings from the face of the bore hole are driven into the debris chamber on the upstroke of the seal, guide and swab piston assembly entrained in fluid within the bore hole. The fluid then is replaced in the bore hole through one of the drain valves for suspending further cuttings. The drilling operation may then proceed until the debris chamber is completely filled. At that time, the tool may be removed to the surface and cleaned for further drilling. This technique eliminates the necessity of having large fluid pumps at the surface for driving circulating fluid down hole to the cutting face and returning it to the surface where it must be treated and the cuttings removed. In the hydrostatic mode, drilling would be performed and the cuttings collected in the debris chamber when the lower valve assembly 126 was opened. The tool 10 would be removed for cleaning and reinserted down hole for further drilling.

Although a single embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A tool for use in a bore hole for debris collection comprising:

a lower assembly having means for mounting an accessory at the lower end thereof, a debris chamber for holding debris, a trap valve in fluid communication with the bore hole and debris chamber for permitting fluid and debris to flow only from the bore hole into the debris chamber, a barrel section having a smooth, cylindrical inner wall, a lower valve assembly in fluid communication with said barrel section and said debris chamber, said lower valve assembly being activatable between an open position permitting fluid flow between the barrel section and debris chamber and a closed position blocking flow therebetween and said barrel section having a closure means for enclosing one end of the inner wall and having a noncircular aperture therethrough;

an upper assembly having a hollow kelley with a noncircular cross section for sliding motion through the aperture in said closure means for joint rotation of said upper and lower assemblies, a piston assembly mounted on the kelley in sliding, sealed contact with the inner wall of the barrel section to define a first chamber within the barrel section, said piston assembly having at least one port for communication between the first chamber and hollow kelley, the closure means and piston assembly being engageable, a fluid container and at least one drain valve for fluid communication between the fluid container and the bore hole to relieve fluid pressure within the fluid container, and an upper valve assembly being positioned for fluid communication between the hollow kelley and fluid container permitting flow only from the hollow kelley to the fluid container;

the tool being operable as a hydraulic clean-out tool by removing said lower valve assembly with said upper valve assembly installed and reciprocating the upper assembly, the upward motion of said piston assembly driving fluid and debris from the bore hole into the debris chamber through the trap valve, the trap valve closing and upper valve assembly opening on the downstroke to release the pressure in the debris chamber, the tool being operable as a hydrostatic tool by removing said upper valve assembly with said lower valve assembly installed, downward motion of said upper assembly activating said lower valve assembly to the open position through contact with said piston assembly driving fluid and debris into the debris chamber.

2. The tool of claim 1 wherein said piston assembly further defines a second chamber within said barrel section, said barrel section having downwardly directed jet ports opening into the bore hole and in fluid communication with the second chamber so that fluid under pressure is forced through the ports during the upstroke of the piston assembly to agitate the debris in the bore hole.

3. The tool of claim 1 further comprising a jet port section having a central passage and at least one jet port directed upwardly from the bore hole and in fluid communication with the passage, said jet port section being placed between the trap valve and the debris chamber and in fluid communication with both during hydrostatic operation to prevent the piston assembly from opening the lower valve assembly during insertion in the bore hole, said jet port section being positioned between the trap valve and accessory and in fluid communication with both during hydraulic operation to drive fluid from the bore hole into the central passage during the upstroke of the piston assembly to agitate and moisturize the fluid in the passage.

4. The tool of claim 1 wherein the accessory is a drill bit, said upper assembly being rotated to rotate said lower assembly and drill bit to drill within the bore hole.

5. The tool of claim 4 wherein the tool is operated to drill within the bore hole and said upper assembly is reciprocated to circulate fluid within the bore hole and deposit cuttings from the drilling within the debris chamber.

6. The tool of claim 1 wherein the upper valve assembly in said upper assembly may be removed when the tool is down hole to permit conventional circulation of fluid to free the tool within the bore hole.

7. The tool of claim 1 wherein said piston assembly and closure means are engageable with sufficient force to jar the lower assembly free when it becomes embeded within the bore hole.

8. A tool for use in a bore hole for debris collection and operable with a drill or tubing string assembly, comprising:

an upper assembly secured to said drill string assembly and including:

(a) a drain valve subassembly having a passage therethrough and at least one drain valve positioned between the passage and bore hole to relieve the fluid pressure in the passage when it exceeds a predetermined level above the pressure in the borehole;

(b) a fluid container subassembly having a fluid container therein in fluid communication with the passage in said drain valve subassembly;

(c) an upper valve subassembly having an interior in fluid communication with the fluid container;

(d) a kelley having a noncircular cross section and a passage therethrough secured in a fixed relation to said upper valve subassembly;

(e) an upper valve assembly extending into the interior of the upper valve subassembly, said upper valve assembly permitting fluid flow from the passage in the kelley to the interior of the upper valve assembly and preventing the reverse flow;

(f) a piston assembly secured to said kelley having a passage therethrough in fluid communication with the passage in the kelley;

a lower assembly including:

(a) a barrel having a smooth, cylindrical inner surface for sealing engagement with said piston assembly, the barrel and piston assembly defining a first chamber varying in volume as the piston assembly slides relative to the inner surface;

(b) a barrel nut secured to said barrel and preventing removal of said piston assembly from said barrel, said barrel nut having a noncircular aperture for passage of the kelley to ensure joint rotation of the upper and lower assemblies, the passage through the piston assembly permitting fluid communication between the passage in the kelley and the first chamber;

(c) a discharge and relief valve subassembly having a passage therethrough in fluid communication with the first chamber and having at least one discharge and relief valve positioned between the passage and bore hole to relieve fluid pressure in the passage when it exceeds a predetermined level above the pressure in the borehole;

(d) a debris chamber subassembly having a debris chamber therein in fluid communication with the passage in said discharge and relief valve subassembly;

(e) a trap valve subassembly having first and second chambers interconnected by a port, the first chamber being in fluid communication with the debris chamber, and a trap valve for closing the port permitting fluid to flow from the second to first chamber and preventing flow from the first to second chamber;

(f) an accessory secured in a fixed relationship to the trap valve subassembly for contacting debris within the bore hole, the second chamber of the trap valve subassembly being in fluid communication with the bore hole;

the reciprocation of said upper assembly by the string assembly reciprocating said piston assembly within said barrel to vary the volume of the first chamber, the upstroke of said piston assembly driving fluid and debris from the bore hole through the trap valve in said trap valve subassembly for depositing the debris in the debris chamber, the downstroke of the piston assembly permitting fluid to flow through the upper valve assembly and drain valves in said drain valve subassembly, said piston assembly and barrel nut being engageable to jar the lower assembly free, the tool further being adapted for use either hydraulically or hydrostatically to provide fluid circulation for operation of the accessory.

9. The tool of claim 8 wherein the piston assembly and barrel define a second chamber, the second chamber being in fluid communication with the bore hole through a passage having at least one downwardly inclined port opening into the bore hole, reciprocation of the piston assembly within the barrel driving fluid within the second chamber to the bore hole through said port at high velocity, agitating the debris and fluid within the bore hole to increase debris collection.

10. The tool of claim 8 further including a jet port subassembly having a passage in fluid communication with the second chamber of said trap valve subassembly and at least one passageway communicating between the passage and bore hole having a jet port upwardly inclined opening into the passage, the reciprocation of the piston assembly forcing fluid from the bore hole into the passage for agitating and moisturizing the fluid and debris for enhanced debris collection.

11. The tool of claim 8 wherein said accessory is a drill bit, rotation of the drill string assembly rotating the upper assembly and lower assembly through said kelley to provide rotation to the drill bit for drilling.

12. The tool of claim 11 wherein drilling is performed by rotating said upper and lower assemblies through the drill string assembly and collection of the cuttings is performed by reciprocating the piston assembly within the barrel to drive fluid and cuttings into the debris container to collect the cuttings.

13. The tool of claim 8 wherein said upper valve assembly includes a fishing neck for attachment to a downhole tool for removing the upper valve assembly and permitting conventional circulation of fluid through the string assembly to free the tool.

14. A down hole tool for debris collection and activatable by a drill for tubing string assembly comprising:

a lower assembly defining an elongate member including:

(a) support means for mounting an accessory at one end of the lower assembly;

(b) a debris chamber for storing debris from the bore hole;

(c) a trap valve for permitting flow of fluid and debris only into the debris chamber from the bore hole;

(d) a discharge and relief valve assembly in fluid communication with said debris chamber for relieving fluid pressure therein to the bore hole;

(e) a jet assembly having at least one upwardly directed jet extending into a passage in the lower assembly in communication with the debris chamber for passage of fluid therethrough to agitate and moisturize the debris and fluid in the passage;

(f) a barrel section defining a smooth, cylindrical interior surface, said barrel section including an upper barrel nut enclosing the interior surface at one end thereof and having a noncircular aperture therethrough, said barrel section having at least one downwardly directed jet communicating with the bore hole for passage of a fluid therethrough to agitate the debris and fluid in the bore hole;

(g) a lower valve assembly for permitting fluid flow between the debris chamber and barrel section in the open position and blocking flow in the closed position;

an upper assembly defining an elongate member for attachment to the drill string assembly including:

(a) a kelley having a hollow passage therethrough and a noncircular cross section for sliding motion through the aperture in the upper barrel nut, the cross section of said kelley and aperture ensuring joint rotation of the upper and lower assemblies upon rotation of the drill string assembly;

(b) a piston assembly secured to said kelley within the barrel section of the lower assembly for sliding sealed contact with the cylindrical interior surface and defining first and second isolated chambers, said upper barrel nut forming a stop to limit the motion of the piston assembly permitting the lower assembly to be jarred free from within the bore hole by upward movement of the string assembly and upper assembly, the piston assembly having at least one passage therethrough permitting fluid communication between the hollow passage in the kelley and the first chamber, said piston assembly further activating the lower valve assembly to the open position on the downstroke of the piston assembly, the jet port communicating with the second chamber;

(c) a fluid container;

(d) an upper valve assembly permitting fluid flow only from the passage in the kelley to the fluid container;

(e) a drain valve assembly permitting fluid communication between the fluid container and the bore hole to relieve pressure within the fluid container into the bore hole, said drain valve further permitting fluid communication between the hollow interior of the drill string assembly and bore hole to relieve fluid pressure within the drill string assembly;

the tool being operable hydraulically by removing said lower valve assembly with the upper valve assembly installed and reciprocating the string assembly and the piston assembly to pump fluid and debris from the bore hole through the trap valve for deposition of debris in the debris chamber, the upper valve assembly being closed on the upstroke of the piston assembly and opening on the downstroke to pass fluid therethrough for discharge through the drain valve assembly to operate the tool as a hydraulic clean-out tool, downward motion of the drill string assembly with said lower valve assembly in the lower assembly and said upper valve assembly removed moving said piston assembly into contact with said lower valve assembly to open the lower valve assembly permitting fluid and debris to enter the debris chamber for depositing debris therein to operate the tool as a hydrostatic clean-out tool.

15. The tool of claim 14 wherein the upward motion of the piston assembly when the tool is operated hydraulically drives fluid within the second chamber through the downwardly directed port to agitate the fluid and debris within the bore hole for enhanced collection of debris.

16. The tool of claim 14 further including a jet port subassembly having an internal passage in fluid communication with the bore hole through at least one upwardly directed port entering the passage, said jet port subassembly being positioned between the trap valve and bore hole when the tool is operated hydraulically to force fluid into the passage from the bore hole to agitate and moisturize the fluid and debris in the passage, said jet port subassembly being positioned between the trap valve and debris chamber when the tool is operated hydrostatically to prevent upward motion of the lower assembly relative to the upper assembly when inserting the tool within the bore hole.

17. The tool of claim 14 wherein the accessory mounted on said attachment means comprises a drill bit, the rotation of the drill string assembly and tool permitting drilling within the bore hole.

18. The tool of claim 17 wherein the tool is operated hydrostatically to drive fluid and cuttings from the drilling into the debris chamber to deposit the cuttings therein to provide continuous drilling until the debris chamber is filled with the cuttings.

19. The tool of claim 14 wherein the upper valve assembly is removable from the tool within the bore hole to permit conventional circulation of fluid to free the tool from within the bore hole.

20. A method for drilling a bore hole comprising the steps of:

rotating a tool with a drill or tubing string assembly, the tool having upper and lower assemblies, a drill bit being mounted on the lower assembly for contact with the formation to be drilled, the drill string assembly being secured to the upper assembly of the tool;

reciprocating the drill string assembly and upper assembly of the tool relative to the lower assembly of the tool, the upper assembly having a piston assembly in slidable sealed contact with a barrel section of the lower assembly having an inner sealing surface therein, the piston assembly being secured to a kelley on the upper assembly, the kelley passing through an aperture in the barrel section, the kelley and aperture having a noncircular cross section to provide joint rotation of the upper and lower assemblies, the upward motion of the piston assembly driving fluid and debris from within the bore hole into a debris container within the lower assembly to deposit the debris therein, the downward motion of the piston assembly driving fluid through an upper valve assembly in the upper assembly and discharging the fluid through at least one drain valve to the bore hole.

21. A method for drilling a bore hole comprising the steps of:

rotating a tool with a drill or tubing string assembly, the tool having upper and lower assemblies, a drill bit being mounted on the lower assembly for contact with the formation to be drilled, the drill or tubing string assembly being secured to the upper assembly of the tool;

moving the drill or tubing string assembly and upper assembly of the tool downwardly toward the lower assembly of the tool, the upper assembly having a piston assembly with a valve opener in slidable sealed contact with a barrel section of the lower assembly having an inner sealing surface therein, the piston assembly being secured to a kelley on the upper assembly, the kelly passing through an aperture in the barrel section, the kelly and aperture having a noncircular cross section to provide joint rotation of the upper and lower assemblies, the downward motion of the piston assembly opening a lower valve assembly through the valve opener permitting fluid and debris from within the bore hole to enter a debris chamber within the lower assembly to deposit the debris therein, the hydrostatic pressure within the bore hole driving the fluid and debris into the debris chamber.

* * * * *

UNITED STATES PATENT AND TRADEMARK OFFICE

CERTIFICATE OF CORRECTION

PATENT NO. : 4,421,182

DATED : December 20, 1983

INVENTOR(S) : Arlin R. Moody and Bobby J. Moody

It is certified that error appears in the above—identified patent and that said Letters Patent is hereby corrected as shown below:

Column 1, line 48, change "prevent" to --permit--;
Column 4, line 45, change "assembly" to --assembly 16--;
Column 6, line 43, change "devide" to --device--;
Column 6, line 52, after "assembly 126" insert --shown in Figs. 2 and 3--;
Column 7, line 1, after "valves" insert --132 and 134--;
Column 12, line 3, change "assembly" to --subassembly--;
Column 13, line 7, change "having" to --forming--;
Column 13, line 21, change "container" to --chamber--;
Column 13, line 28, change "for" to --or--;
Column 13, line 42, after "jet" insert --port--;
Column 13, line 52, after "jet" insert --port--;
Column 13, line 61, after "to the" delete "drill";
Column 13, line 67, after "of the" delete "drill";
Column 14, line 57, after "subassembly" insert --forming said jet assembly,--;
Column 14, line 59, after "directed" insert --jet--;

UNITED STATES PATENT AND TRADEMARK OFFICE

CERTIFICATE OF CORRECTION

PATENT NO. : 4,421,182

DATED : December 20, 1983

INVENTOR(S) : Arlin R. Moody and Bobby J. Moody

It is certified that error appears in the above—identified patent and that said Letters Patent is hereby corrected as shown below:

Column 15, line 2, delete "attachment" and insert --support--;
Column 15, line 3, after "of the" delete "drill";
Column 14, line 27, after "of the" delete "drill";
Column 14, line 28, after "within the" delete "drill";
Column 14, line 42, after "of the" delete "drill";
Column 14, line 53, after "directed" insert --jet--;
Column 15, line 17, after "a" delete "drill";
Column 15, line 22, after "reciprocating the" delete "drill";

Signed and Sealed this

*Fifteenth* Day of *May 1984*

[SEAL]

*Attest:*

GERALD J. MOSSINGHOFF

*Attesting Officer*

*Commissioner of Patents and Trademarks*